US011450942B2

(12) United States Patent
Murata et al.

(10) Patent No.: US 11,450,942 B2
(45) Date of Patent: Sep. 20, 2022

(54) ANTENNA MODULE AND COMMUNICATION DEVICE EQUIPPED WITH THE SAME

(71) Applicant: Murata Manufacturing Co., Ltd., Kyoto (JP)

(72) Inventors: Takaki Murata, Kyoto (JP); Kengo Onaka, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/992,463

(22) Filed: Aug. 13, 2020

(65) Prior Publication Data

US 2020/0373646 A1 Nov. 26, 2020

Related U.S. Application Data

(63) Continuation of application No. PCT/JP2019/002029, filed on Jan. 23, 2019.

(30) Foreign Application Priority Data

Feb. 22, 2018 (JP) ..... JP2018-029845

(51) Int. Cl.

| | |
|---|---|
| ***H01Q 1/22*** | (2006.01) |
| ***H01Q 5/357*** | (2015.01) |
| ***H01Q 1/38*** | (2006.01) |
| ***H01Q 1/50*** | (2006.01) |

(52) U.S. Cl.

CPC ..... *H01Q 1/2208* (2013.01); *H01Q 1/38* (2013.01); *H01Q 1/50* (2013.01); *H01Q 5/357* (2015.01)

(58) Field of Classification Search

CPC ..... H01Q 1/2208; H01Q 5/357; H01Q 1/38; H01Q 1/50; H01Q 21/0075; H01Q 21/08; H01Q 9/0407; H01Q 1/2283

See application file for complete search history.

(56) References Cited

U.S. PATENT DOCUMENTS

| | | | |
|---|---|---|---|
| 2017/0222316 A1 | 8/2017 | Mizunuma et al. | |
| 2017/0229769 A1 | 8/2017 | Yokoyama et al. | |
| 2019/0067219 A1* | 2/2019 | Lasiter | H01Q 9/0407 |

FOREIGN PATENT DOCUMENTS

| | | |
|---|---|---|
| JP | 05-152831 A | 6/1993 |
| JP | H06-283924 A | 10/1994 |
| JP | 2005-051329 A | 2/2005 |

(Continued)

OTHER PUBLICATIONS

International Search Report issued in Application No. PCT/JP2019/002029, dated Mar. 5, 2019.

(Continued)

*Primary Examiner* — Seung H Lee

(74) *Attorney, Agent, or Firm* — Pearne & Gordon LLP

(57) ABSTRACT

An antenna module (100) includes at least one antenna element (121), a ground electrode (GND1), and a dielectric layer (130), which is provided between the antenna element (121) and the ground electrode (GND1), and on which the antenna element (121) is mounted. A space (132) is formed between the dielectric layer (130) and the ground electrode (GND1) in a region where the antenna element (121) and the ground electrode (GND1) overlap each other when the dielectric layer (130) is seen in a plan view.

20 Claims, 11 Drawing Sheets

(56) References Cited

FOREIGN PATENT DOCUMENTS

| | | | |
|---|---|---|---|
| JP | 2013-187731 | A | 9/2013 |
| WO | 2016/063759 | A1 | 4/2016 |
| WO | 2016/067969 | A1 | 5/2016 |

OTHER PUBLICATIONS

Written Opinion issued in Application No. PCT/JP2019/002029, dated Mar. 5, 2019.

* cited by examiner

ANTENNA MODULE AND COMMUNICATION DEVICE EQUIPPED WITH THE SAME

This is a continuation of International Application No. PCT/JP2019/002029 filed on Jan. 23, 2019 which claims priority from Japanese Patent Application No. 2018-029845 filed on Feb. 22, 2018. The contents of these applications are incorporated herein by reference in their entireties.

BACKGROUND OF THE DISCLOSURE

Field of the Disclosure

The present disclosure relates to an antenna module and a communication device equipped with the same, and more particularly, to an antenna structure able to reduce an effective dielectric constant.

Description of the Related Art

WO 2016/067969 (Patent Document 1) discloses an antenna module in which an antenna element and a radio frequency semiconductor element are integrated to be mounted on a dielectric substrate.
Patent Document 1: WO 2016/067969

BRIEF SUMMARY OF THE DISCLOSURE

In such an antenna, antenna characteristics such as a frequency band width of a transmittable radio frequency signal, a peak gain, and loss are affected by a dielectric constant of a dielectric substrate on which an antenna element is mounted.

The loss characteristics of an antenna are generally considered to be improved as a relative dielectric constant ($\varepsilon r$) and a dielectric loss tangent ($\tan \delta$) of a dielectric substrate are lower. Accordingly, in order to achieve a high peak gain of the antenna and reduce power consumption of the device, it is necessary to reduce a dielectric constant of the dielectric substrate.

On the other hand, as for the frequency band width, in general, as the thickness of the dielectric substrate (in other words, the distance between an antenna element and a ground electrode) increases, the frequency bandwidth becomes wider. In recent years, a mobile terminal such as a smart phone has been particularly required to be thinner, so that an antenna module itself has been needed to be downsized and thinned. However, when a dielectric substrate is thinned, there may arise a problem that the frequency band width of the antenna is narrowed.

The present disclosure has been conceived in order to solve the above described problem, and an object thereof is to achieve a wider band width and to lessen the loss in an antenna module.

An antenna module according to an aspect of the present disclosure includes at least one radiating element, a ground electrode, and a dielectric layer which is provided between the at least one radiating element and the ground electrode, and on which the at least one radiating element is mounted. A space is formed between the dielectric layer and the ground electrode in a region where the at least one radiating element and the ground electrode overlap each other when the dielectric layer is seen in a plan view.

Preferably, the dielectric layer has a first portion in which the at least one radiating element is disposed, and a second portion in which the at least one radiating element is not disposed. A thickness of the dielectric layer in a normal line direction in the second portion is thinner than a thickness of the dielectric layer in the normal line direction in the first portion.

Preferably, the antenna module further includes at least one feeding circuit and a feeding line. The at least one feeding circuit is mounted in or on the dielectric layer and is configured to supply radio frequency power to the at least one radiating element. The feeding line is formed in the dielectric layer, and transmits radio frequency power from the at least one feeding circuit to the at least one radiating element.

Preferably, the antenna module further includes at least one feeding circuit mounted in or on the dielectric layer and configured to supply radio frequency power to the at least one radiating element. The at least one feeding circuit is disposed in the first portion of the dielectric layer.

Preferably, the antenna module further includes at least one feeding circuit mounted in or on the dielectric layer and configured to supply radio frequency power to the at least one radiating element. The at least one feeding circuit is disposed in the second portion of the dielectric layer.

Preferably, the antenna module further includes at least one feeding circuit mounted in or on the dielectric layer and configured to supply radio frequency power to the at least one radiating element. The dielectric layer further has a third portion in which the thickness of the dielectric layer in the normal line direction is thicker than the thickness in the second portion, and which is different from the first portion. The at least one feeding circuit is disposed in the third portion.

Preferably, the antenna module further includes another radiating element disposed in the third portion. The at least one feeding circuit is disposed on a surface on the opposite side to a surface on which the other radiating element is disposed in the third portion.

Preferably, the at least one radiating element is more than one in number, and the plurality of radiating elements is disposed separate from one another in a planar direction of the dielectric layer. The feeding circuit is provided corresponding to each of the radiating elements.

Preferably, an upper surface of the second portion is continuously connected with a lower surface of the space formed in the dielectric layer.

Preferably, the ground electrode is formed on the lower surface of the space.

Preferably, when the dielectric layer is seen in a plan view, the entirety of the at least one radiating element overlaps the space described above.

Preferably, the dielectric layer has a first portion in which one end portion of the dielectric layer is bent to face, and a second portion in which the one end portion does not face. A thickness of the dielectric layer in a normal line direction in the second portion is thinner than a thickness of the dielectric layer in the normal line direction in the first portion.

Preferably, the dielectric layer bends in a direction orthogonal to an extending direction of the dielectric layer from the first portion to the second portion when seen in a plan view from the normal line direction of the dielectric layer. The bend is started in the space in the first portion.

A communication device according to another aspect of the present disclosure includes any one of the above-described antenna modules and a housing that is at least partially formed of resin. The at least one radiating element of the antenna module is disposed so as to face the resin portion in the housing.

In the antenna module according to the present disclosure, a space is formed between the dielectric layer on which the radiating element (antenna element) is disposed and the ground electrode, which makes it possible to reduce the effective dielectric constant from the radiating element to the ground electrode. Accordingly, in the antenna module, it is possible to achieve a wider band width and lessen the loss.

Figure 5A:
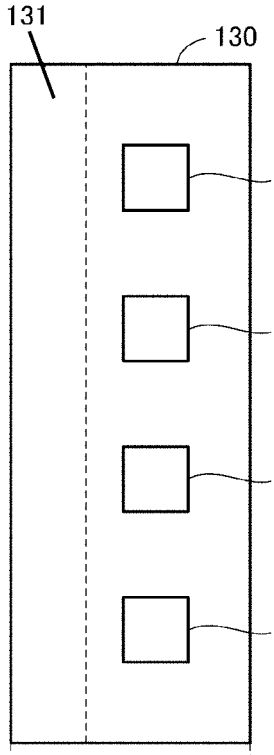
Figure 5B:
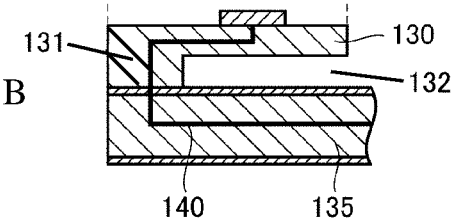

Each of FIGS. 5A and 5B is a diagram explaining a first example of a structure of a dielectric layer.

Figure 6A:
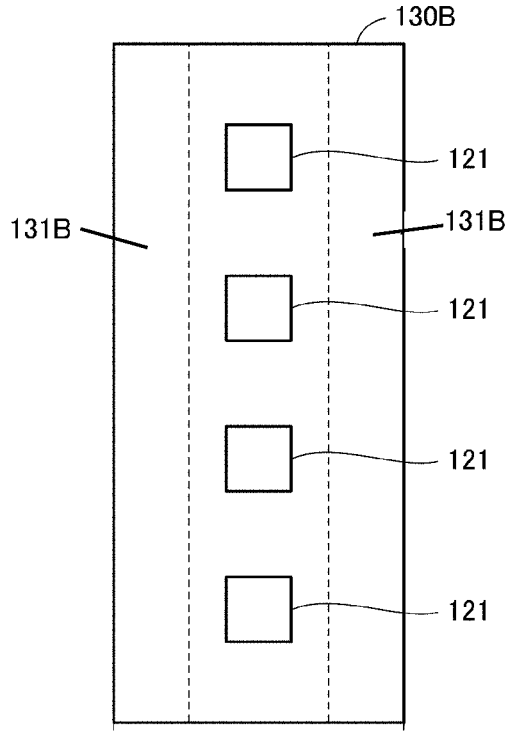
Figure 6B:
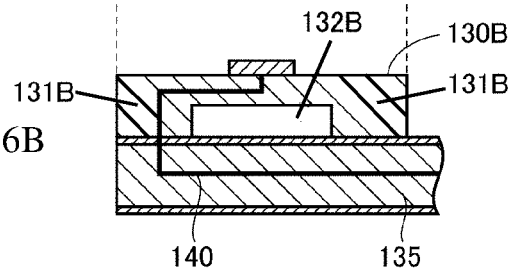

Each of FIGS. 6A and 6B is a diagram explaining a second example of a structure of a dielectric layer.

Figure 7A:
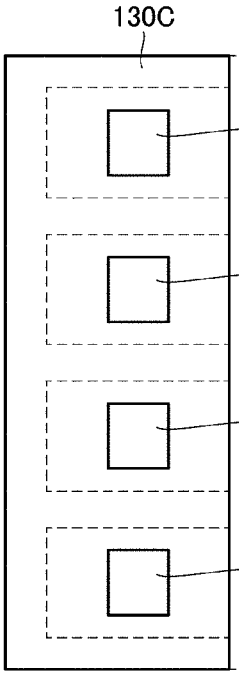
Figure 7B:
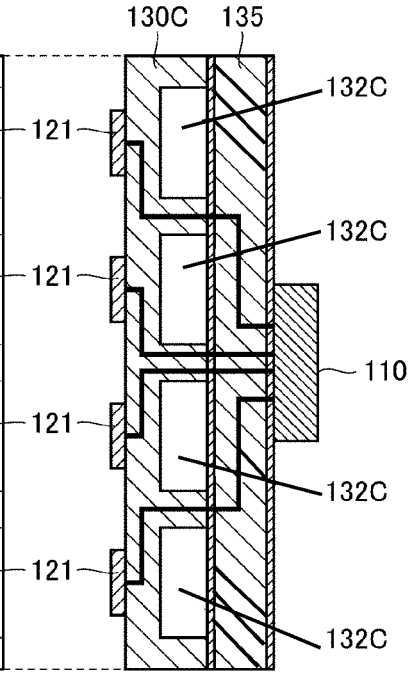

Each of FIGS. 7A and 7B is a diagram explaining a third example of a structure of a dielectric layer.

Figure 8:
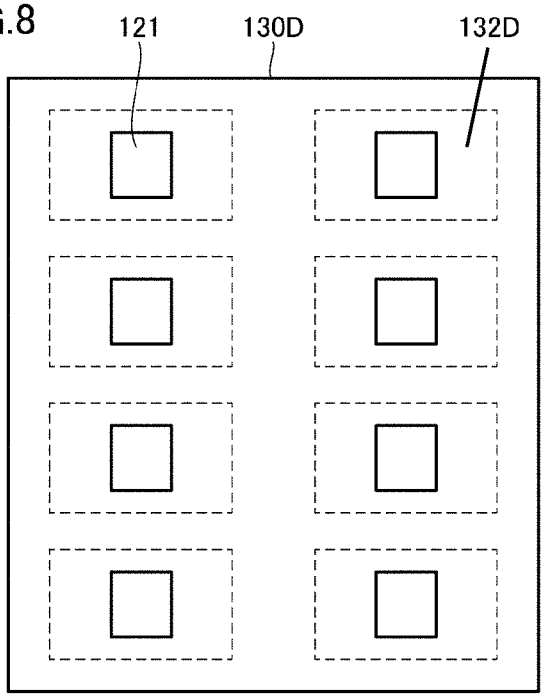

FIG. 8 is a diagram explaining a fourth example of a structure of a dielectric layer.

Figure 9:
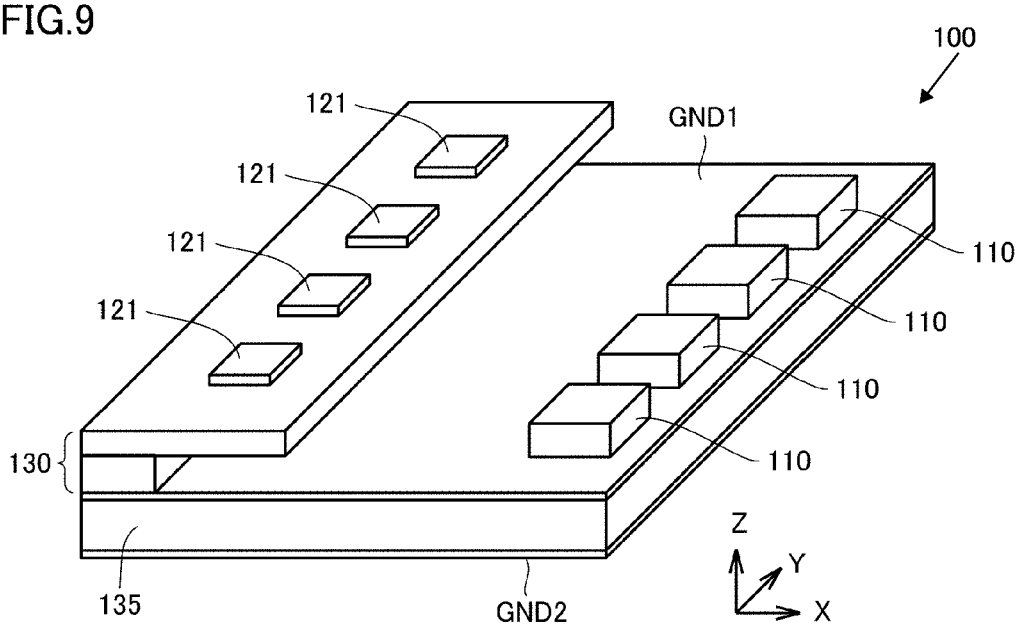

FIG. 9 is a perspective view of an example of an antenna module in a case of using the structure in FIGS. 5A and 5B.

Figure 4:
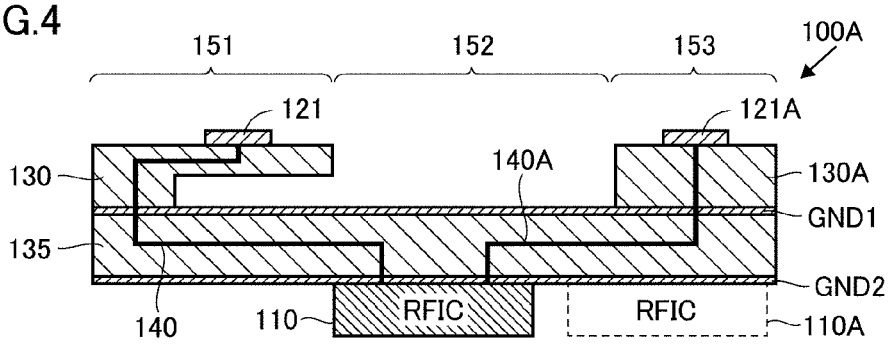
FIG. 4 is a cross-sectional view of a second example of an antenna module according to the first embodiment.
Figure 10A:
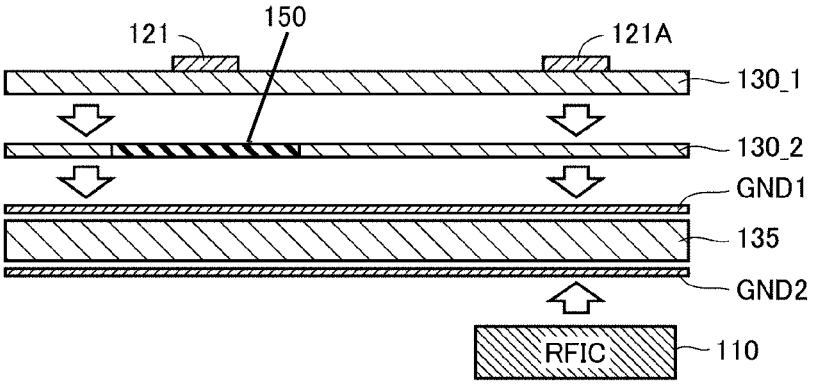
Figure 10B:
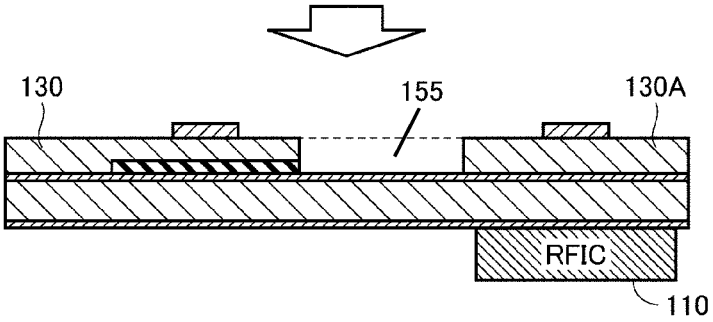
Figure 10C:
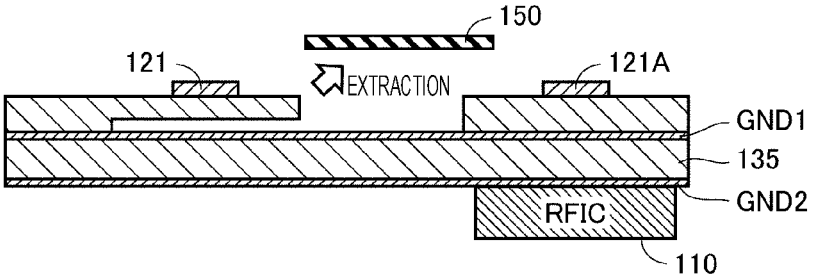

Each of FIGS. 10A, 10B and 10C is a diagram explaining a first example of a manufacturing process of the antenna module in FIG. 4.

Figures 11A, 11B:
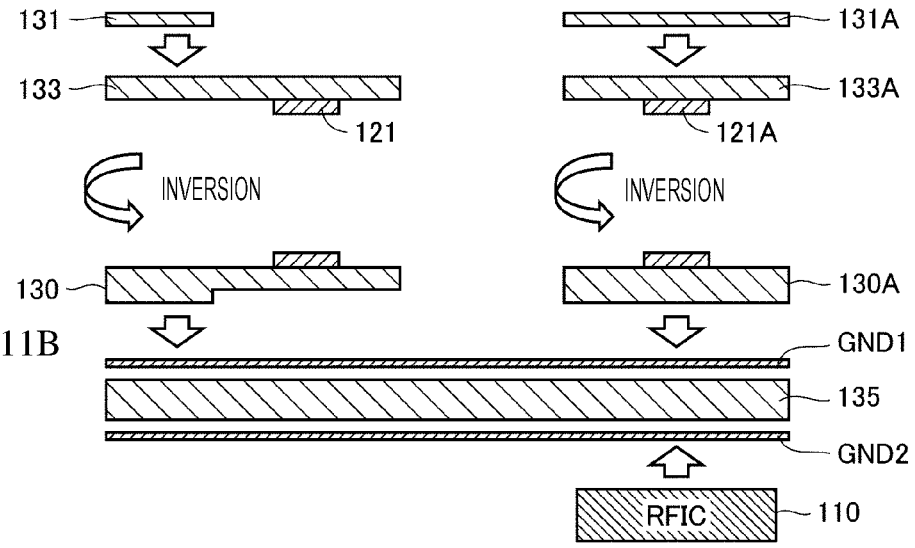

Each of FIGS. 11A and 11B is a diagram explaining a second example of a manufacturing process of the antenna module in FIG. 4.

Figures 12A, 12B, 12C:
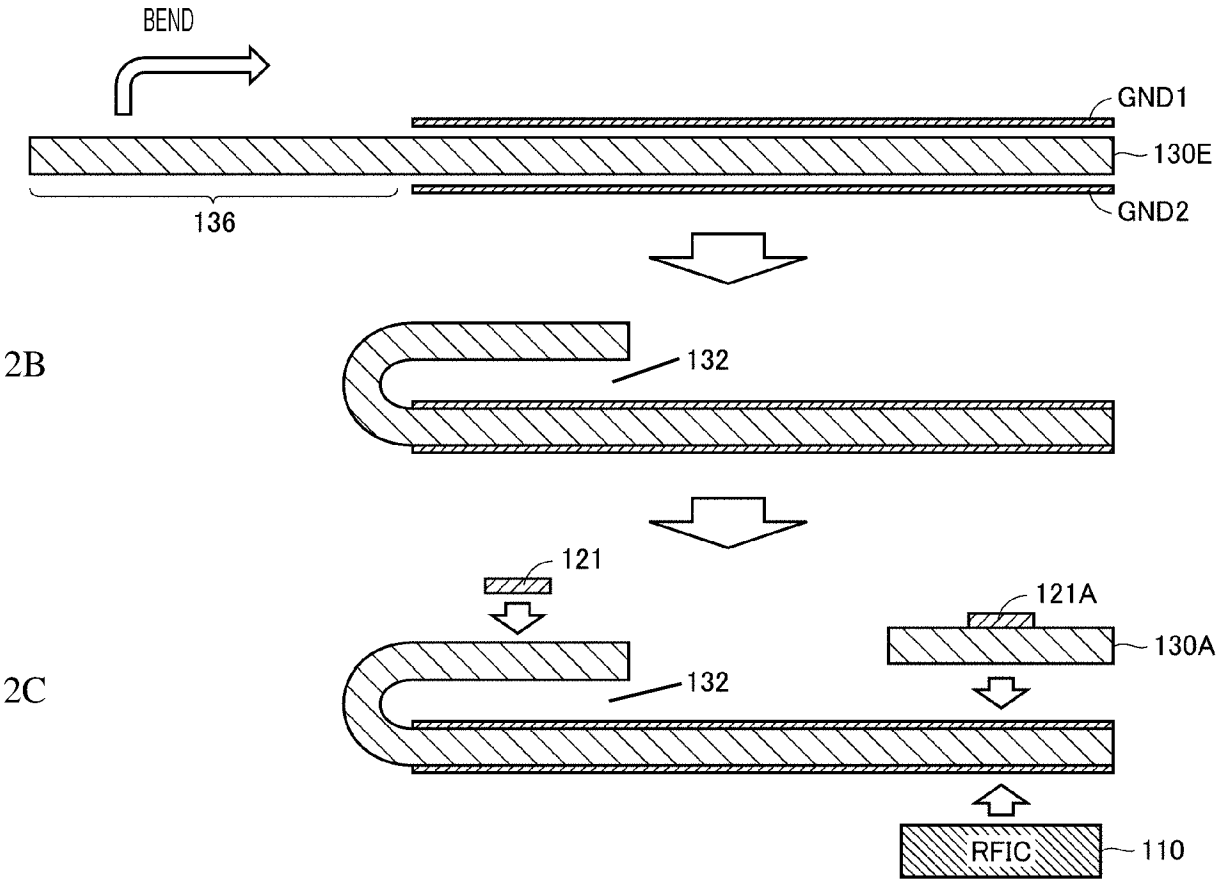

Each of FIGS. 12A, l2B and l2C is a diagram explaining a third example of a manufacturing process of the antenna module in FIG. 4.

Figure 13:
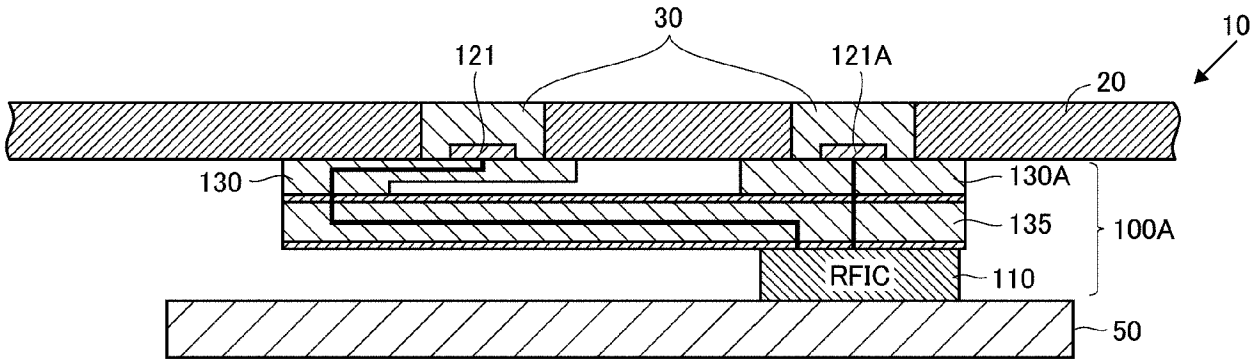

FIG. 13 is an example of antenna module arrangement in a communication device equipped with the antenna module in FIG. 4.

Figure 14A:
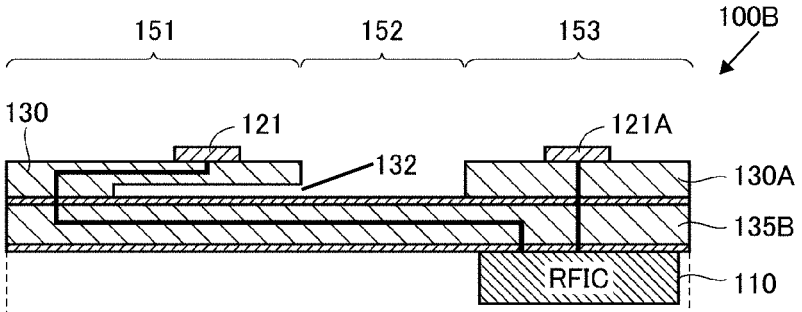
Figure 14B:
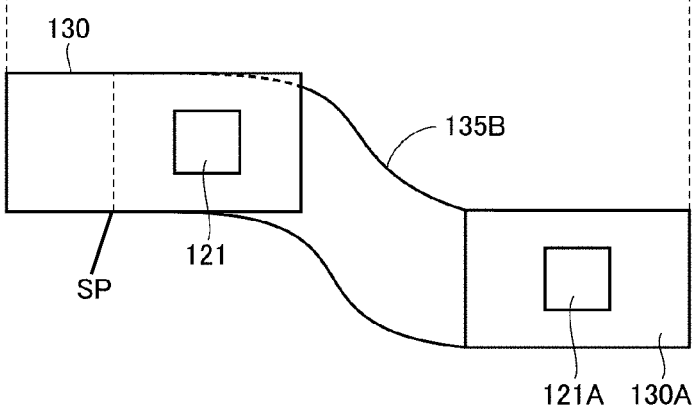

Each of FIGS. 14A and 14B is a diagram for explaining an antenna module according to a second embodiment.

DETAILED DESCRIPTION OF THE DISCLOSURE

Hereinafter, embodiments of the present disclosure will be described in detail with reference to the accompanying drawings. Note that the same or corresponding constituent elements in the drawings are denoted by the same reference symbols, and the description thereof will not be repeated.

First Embodiment (Basic Configuration of Communication Device)

Figure 1:
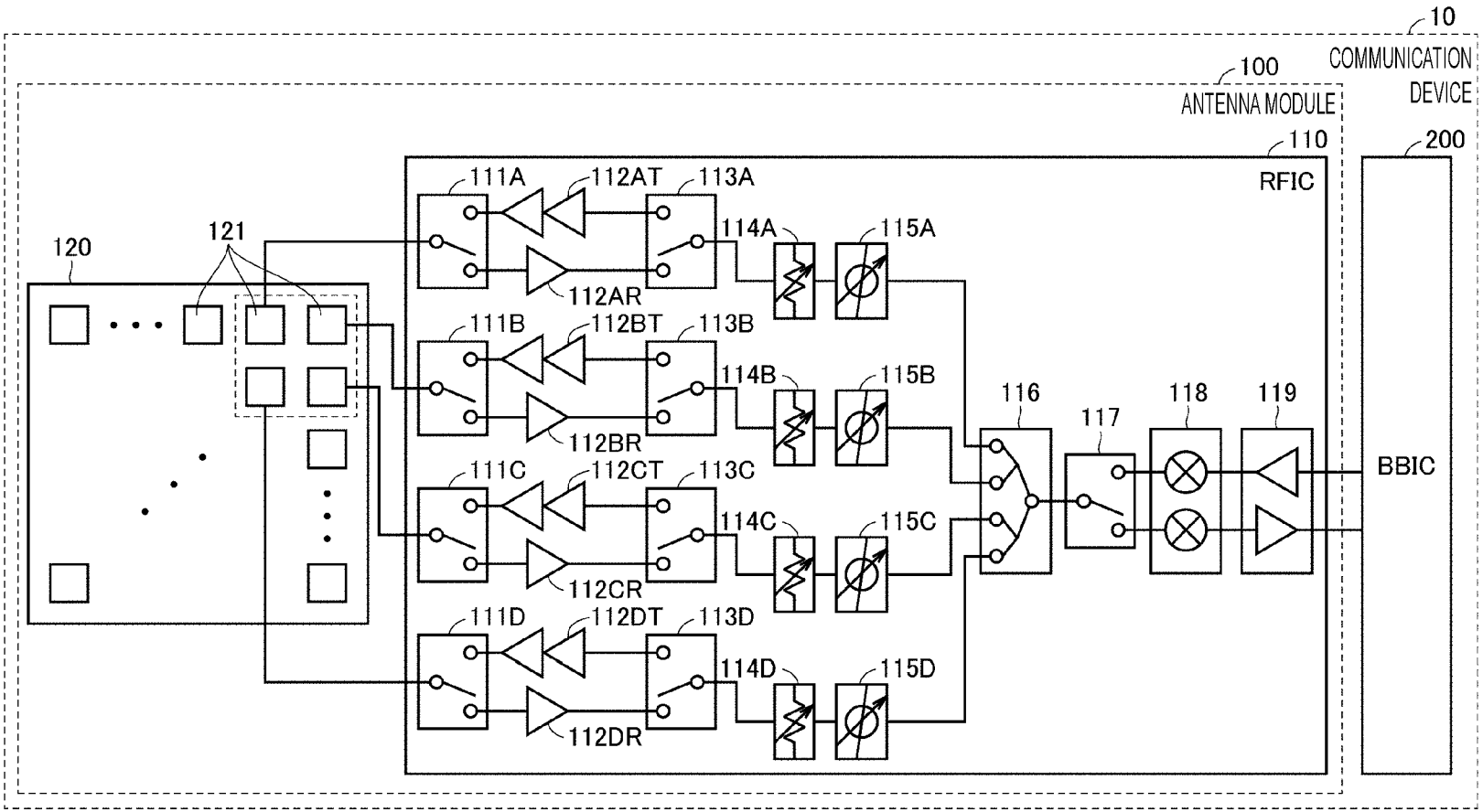
FIG. 1 is a block diagram of a communication device to which an antenna module is applied.

FIG. 1 is a block diagram of an example of a communication device 10 to which an antenna module 100 according to the embodiment is applied. The communication device 10 is, for example, a mobile terminal such as a cellular phone, a smart phone, a tablet or the like, or a personal computer having a communication function.

Referring to FIG. 1, the communication device 10 includes the antenna module 100 and a BBIC 200, which constitutes a baseband signal processing circuit. The antenna module 100 includes a radio frequency integrated circuit (RFIC) 110, which is an example of a radio frequency element, and an antenna array 120. The communication device 10 up-converts a signal transmitted from the BBIC 200 to the antenna module 100 into a radio frequency signal so as to radiate the converted signal through the antenna array 120, and down-converts a radio frequency signal received by the antenna array 120 and performs signal processing on the converted signal in the BBIC 200.

In FIG. 1, for ease of explanation, among a plurality of antenna elements (radiating elements) 121 constituting the antenna array 120, only a configuration corresponding to four antenna elements 121 is illustrated, and configurations corresponding to the other antenna elements 121 having a similar configuration are omitted.

The RFIC 110 includes switches 111A to 111D, 113A to 113D and 117, power amplifiers 112AT to 112DT, low-noise amplifiers 112AR to 112DR, attenuators 114A to 114D, phase shifters 115A to 115D, a signal synthesizer/demultiplexer 116, a mixer 118, and an amplification circuit 119.

When transmitting a radio frequency signal, the switches 111A to 111D and 113A to 113D are switched to the side of the power amplifiers 112AT to 112DT, and the switch 117 is connected to a transmission-side amplifier of the amplification circuit 119. When receiving a radio frequency signal, the switches 111A to 111D and 113A to 113D are switched to the side of the low-noise amplifiers 112AR to 112DR, and the switch 117 is connected to a reception-side amplifier of the amplification circuit 119.

A signal transmitted from the BBIC 200 is amplified by the amplification circuit 119, and is up-converted by the mixer 118. The transmission signal, which is an up-converted radio frequency signal, is demultiplexed by the signal synthesizer/demultiplexer 116 into four signals, and the demultiplexed signals are respectively fed, passing through four signal paths, to the different antenna elements 121. At this time, the directivity of the antenna array 120 may be adjusted by individually adjusting the phase shift degrees of the phase shifters 115A to 115D disposed in each of the corresponding signal paths.

Additionally, the reception signals, which are radio frequency signals received by each of the antenna elements 121, respectively pass through the four different signal paths, and then multiplexed by the signal synthesizer/demultiplexer 116. The multiplexed reception signal is down-converted by the mixer 118, amplified by the amplification circuit 119, and then transmitted to the BBIC 200.

The RFIC 110 is formed as, for example, a single chip integrated circuit component including the above-described circuit configuration. Alternatively, the units (switches, power amplifiers, low-noise amplifiers, attenuators, and phase shifters) in the RFIC 110 corresponding to each of the antenna elements 121 may be formed as a single chip integrated circuit component for each corresponding antenna element 121.

(Structure of Antenna Module)

Figure 2:
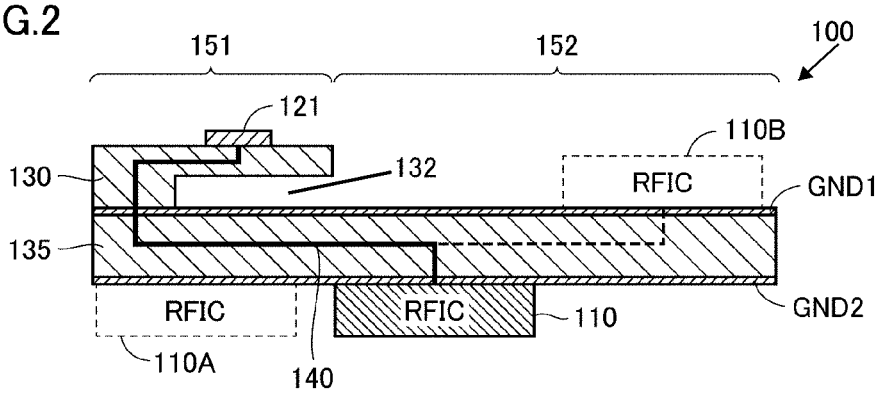
FIG. 2 is a cross-sectional view of a first example of an antenna module according to a first embodiment.

FIG. 2 is a cross-sectional view of a first example of the antenna module according to a first embodiment. Referring to FIG. 2, the antenna module 100 includes, in addition to the antenna element 121 and the RFIC 110, a first dielectric layer 130, a second dielectric layer 135, and ground electrodes GND1 and GND2. In FIG. 2, for ease of explanation, a case where only one antenna element 121 is disposed will be described, but a plurality of antenna elements 121 may be disposed.

The first dielectric layer 130 and the second dielectric layer 135 (hereinafter, also collectively referred to as "dielectric layer") are formed of, for example, resin such as epoxy, polyimide or the like. Also, the dielectric layer may be formed by using a liquid crystal polymer (LCP) having a lower dielectric constant or fluorine-based resin.

The second dielectric layer 135 is formed in a flat plate shape, for example, and the ground electrodes GND1 and GND2 are laminated on front and rear surfaces thereof, respectively.

The first dielectric layer 130 is partially disposed on the ground electrode GND1, and the antenna element 121 is disposed on a front surface of the first dielectric layer 130. In FIG. 2, when the antenna module 100 is seen in a plan view from the normal line direction of the dielectric layer, a portion where the first dielectric layer 130 is disposed (i.e., a portion where the thickness in the normal line direction is thick) is referred to as a first portion 151, and a portion where the first dielectric layer 130 is not present and the thickness in the normal line direction is thin is referred to also as a second portion 152. As described above, by thinning the portion where the antenna element is not disposed (second portion 152), it is possible to contribute to the high integration of the entire device in which the antenna module is mounted.

The RFIC 110 is disposed so as to be in contact with the ground electrode GND2. A radio frequency signal outputted from the RFIC 110 is transmitted, through a feeding line 140, to the antenna element 121. The feeding line 140 is connected to the antenna element 121 while passing through the second dielectric layer 135 and further passing through the first dielectric layer 130.

In FIG. 2, the RFIC 110 is disposed in the second portion 152 of the ground electrode GND2, but may be disposed in the first portion 151 (a broken-line portion 110A in FIG. 2). The RFIC may be disposed on the ground electrode GND1 on the same side as the first dielectric layer 130 (a broken-line portion 110B in FIG. 2).

In the first dielectric layer 130, a space 132 is partially formed in a thickness direction (the normal line direction of the dielectric layer). When the dielectric layer is seen in a plan view, the antenna element 121 is disposed such that at least part thereof overlaps a region where the space 132 is formed. It is more preferable that the overall antenna element 121 overlap with the space 132.

The lower boundary of the space 132 in the first portion 151 is the ground electrode GND1, and is continuously connected with the upper surface of the second portion 152.

The reason why the space 132 is provided between the first dielectric layer 130 and the second dielectric layer 135 will be described below with reference to a comparative example in FIG. 3.

Figure 3:
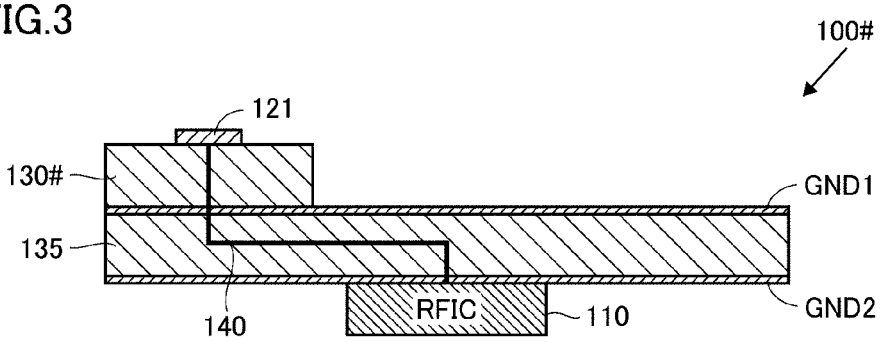
FIG. 3 is a cross-sectional view of an antenna module of a comparative example.

FIG. 3 is a cross-sectional view of an antenna module 100# of the comparative example. The configuration of the antenna module 100# illustrated in FIG. 3 is such that the first dielectric layer 130 in the antenna module 100 in FIG. 2 is replaced with a first dielectric layer 130#. The first dielectric layer 130# is solid, so that the space 132 as in the first dielectric layer 130 of FIG. 2 is not formed.

Here, as the characteristics of an antenna module, it is generally required to widen a frequency band width that can be transmitted and received, and to lessen the loss when a radio frequency signal is transmitted. It is generally known that the loss characteristics of an antenna are improved as a relative dielectric constant ($\varepsilon r$) and a dielectric loss tangent ($\tan \delta$) of a dielectric layer where the antenna element is disposed are lower; therefore, in order to achieve a high peak gain of the antenna and reduce the power consumption of the device, it is necessary to reduce the dielectric constant of the dielectric layer.

On the other hand, as for widening the band width, it is known that the thicker the thickness of the dielectric layer (i.e., the distance between the antenna element and the ground electrode) is, the wider the band width becomes. In recent years, a mobile terminal such as a smart phone has been particularly required to be thinner, so that an antenna module itself has been needed to be thinned. However, when the dielectric layer is thinned in order to achieve a reduction in thickness, the frequency band width of the antenna may be narrowed.

In the antenna module 100# of the comparative example in FIG. 3, in order to secure a wide frequency band width, it is necessary to increase the thickness of the first dielectric layer 130# in the normal line direction. However, in that case, since the height of the antenna module becomes higher, the need for being thinned is not met.

On the other hand, in the first embodiment illustrated in FIG. 2, since the space 132 is formed between the antenna element 121 and the ground electrode GND1 in the first dielectric layer 130 on which the antenna element 121 is disposed, even when a distance between the antenna element 121 and the ground electrode GND1 is the same as that in the comparative example illustrated in FIG. 3, the effective dielectric constant between the antenna element 121 and the ground electrode GND1 may be further reduced. Accordingly, by providing the space 132 in the first dielectric layer 130 on which the antenna element 121 is disposed, it is possible to achieve an improvement in the frequency band width and a reduction in the loss.

As in the first embodiment, by forming the space 132 in the first dielectric layer 130, the effective dielectric constant between the antenna element 121 and the ground electrode GND1 may be reduced, and thus the frequency band width and the antenna gain may be improved. Alternatively, by reducing the thickness of the first dielectric layer 130, it is also possible to further reduce the effective dielectric constant and achieve a lower profile.

FIG. 4 is a cross-sectional view of a second example of an antenna module according to the first embodiment. In an antenna module 100A in FIG. 4, in addition to the configuration of the antenna module 100 in FIG. 2, a third dielectric layer 130A disposed on the ground electrode GND1 is provided, and an antenna element 121A is further disposed on the third dielectric layer 130A. A radio frequency signal is transmitted to the antenna element 121A through a feeding line 140A.

When the antenna module 100A is seen in a plan view from the normal line direction of the dielectric layer, a portion where the third dielectric layer 130A is disposed is referred to as a third portion 153. In the third portion 153 in FIG. 4, although no space is provided in the third dielectric layer 130A, a space may be provided in the same manner as in the first dielectric layer 130.

In FIG. 4, the RFIC 110 is disposed so as to be in contact with the second portion 152 of the ground electrode GND2, but may be disposed in the first portion 151 or the third portion 153 of the ground electrode GND2.

(Specific Example of First Dielectric Layer)

Next, some examples of the structure of the first dielectric layer that forms the space will be described with reference to FIGS. 5A to 8. In FIGS. 5A to 8, a case of an array antenna formed of a plurality of rectangular antenna elements 121 (patch antennas) will be described.

In an example of FIGS. 5A and 5B, as in FIG. 2, the first dielectric layer 130 has an L-shaped cross section, and is attached onto the ground electrode GND1 by a support portion 131. As illustrated in FIG. 5A, the first dielectric layer 130 extends in a planar direction orthogonal to a direction from the first portion 151 toward the second portion 152, and the plurality of (four in FIGS. 5A and 5B) antenna elements 121 is disposed to be separate from one another at substantially equal intervals.

Each of FIGS. 6A and 6B illustrates an example of a first dielectric layer 130B having a C-shaped cross section. The first dielectric layer 130B is attached onto the ground electrode GND1 by two support portions 131B extending in an alignment direction of the antenna elements 121 in FIG. 6A, and a space 132B is formed between the two support portions 131B.

In an example of a first dielectric layer 130C illustrated in FIGS. 7A and 7B, a support portion is formed along three sides of each antenna element 121 having a rectangular shape, and a space 132C is formed individually for each of the antenna elements 121.

FIG. 8 is an example of a case where the plurality of antenna elements 121 is two-dimensionally arranged, where eight antenna elements 121 are arranged in a form of 2 by 4. In a first dielectric layer 130D, a support portion is formed along four sides of each antenna element 121 having a rectangular shape, and a space 132D is formed individually for each of the antenna elements 121.

Note that, in any of FIGS. 5A to 8, the entirety of each antenna element 121 overlaps the space 132 when seen in a plan view from the normal line direction of the dielectric layer, but the antenna element 121 and the support portion may partially overlap each other. However, also in this case, the overlapping portion of the antenna element 121 and the support portion is preferably symmetrical in a plan view, and this symmetry may be preferably applied to each of the antenna elements 121 in terms of the directivity of the antenna.

FIG. 9 is a perspective view of an example of an antenna module in a case of using the first dielectric layer in the structure illustrated in FIGS. 5A and 5B. As illustrated in FIG. 9, the plurality of antenna elements 121 is arranged separate from one another on the first dielectric layer 130 extending in a Y direction in FIG. 9.

For each of the antenna elements 121, the RFIC 110 is arranged on the ground electrode GND1 separated in an X direction in FIG. 9. Each RFIC 110 transmits a radio frequency signal to the corresponding antenna element 121.

As described above, in the antenna module, by providing a space between the antenna element and the ground electrode in a portion of the dielectric layer where the antenna element is disposed, it is possible to reduce the effective dielectric constant while securing the distance between the antenna element and the ground electrode. This makes it possible to lessen the loss and improve the antenna performance while maintaining the frequency band width.

(Manufacturing Process)

Next, a manufacturing process of the antenna module according to the first embodiment will be described with reference to FIGS. 10A to 13. In the following description, the case of the antenna module 100A illustrated in FIG. 4 will be exemplified and explained.

(First Process Example)

Each of FIGS. 10A, 10B and 10C is a diagram explaining a first example of a manufacturing process of the antenna module 100A in FIG. 4.

First, referring to FIG. 10A, the ground electrode GND1 and the ground electrode GND2 are laminated on the front surface and the rear surface of the second dielectric layer 135, respectively.

The first dielectric layer 130 is formed by laminating a first layer 130_1 on which the antenna elements 121 and 121A are to be disposed, and a second layer 130_2 in which the space 132 is to be formed. First, the second layer 130_2 is laminated on the ground electrode GND1. At this time, a member 150 of a material different from that of the first dielectric layer 130, such as stainless steel, is disposed in a portion where the space 132 is to be formed.

The first layer 130_1 is laminated on the second layer 130_2, and further the antenna elements 121 and 121A are disposed on the first layer 130_1. The RFIC 110 is disposed on the ground electrode GND2 on the rear surface side of the second dielectric layer 135.

Thereafter, as illustrated in FIG. 10B, a portion of the first layer 130_1 and the second layer 130_2 corresponding to the second portion 152 in FIG. 4 is removed by laser processing or cutting processing until the ground electrode GND1 is exposed.

Then, the member 150 is extracted from a portion in a space 155 where the first dielectric layer 130 has been removed, whereby the space 132 is formed under the antenna element 121 (FIG. 10C).

Note that, in the above explanation, a case in which the member 150 is physically extracted is described. However, for example, the member 150 may be formed of resin or the like that can be dissolved, and may be chemically removed by etching.

As described above, in the manufacturing process of FIGS. 10A, 10B and 10C, in a state in which the member 150 of a material different from that of the first dielectric layer 130 is disposed in a portion where the space 132 is to be formed, the layers are sequentially laminated, the first dielectric layer 130 corresponding to the second portion 152 is removed, and thereafter the member 150 is removed from the space 155 formed by the removal of the first dielectric layer 130, whereby the space 132 is formed.

(Second Process Example)

Each of FIGS. 11A and 11B is a diagram explaining a second example of the manufacturing process of the antenna module 100A. In a process example illustrated in FIGS. 11A and 11B, an example will be described in which the antenna module 100A is manufactured only by a lamination process, without using the removal process of the first dielectric layer 130 and the extraction process of the member 150 as illustrated in FIGS. 10A, 10B and 10C.

First, referring to FIG. 11A, the first portion 151 is formed by laminating a main body portion 133 of the first dielectric layer 130 and the support portion 131 on the antenna element 121. Also, the third portion 153 is formed by laminating a main body portion 133A of the first dielectric layer 130A and a support portion 131A on the antenna element 121A. Note that the third portion 153 may be formed as a single member instead of a laminated structure of the main body portion 133A and the support portion 131A.

Thereafter, the first portion 151 of the first dielectric layer 130 and the third portion 153 of the first dielectric layer 130A formed in FIG. 11A are inverted vertically, and are laminated on the ground electrode GND1 on the front surface of the second dielectric layer 135. Further, similarly to the example of FIGS. 10A, 10B and 10C, the RFIC 110 is disposed on the ground electrode GND2 on the rear surface side of the second dielectric layer 135.

As described above, in FIGS. 11A and 11B, the main body portion of the first dielectric layer and the support portion are laminated on each of the antenna elements 121 and 121A, and these laminated structures are inverted vertically and then laminated on the second dielectric layer 135, thereby forming the space 132. Accordingly, it is possible to form the space 132 without using the removal process of the first dielectric layer by laser processing or the like and without using the extraction process of the member 150, which is disposed in advance in the portion where the space 132 is to be formed.

The process of the second example is particularly effective in a case where the support portion is formed on four sides of the space as illustrated in FIG. 8.

(Third Process Example)

Each of FIGS. 12A, 12B and 12C is a diagram explaining a third example of the manufacturing process of the antenna module 100A. In a process example illustrated in FIGS. 12A, 12B and 12C, an example will be described in which the first portion 151 including the space 132 is formed by bending an end portion of a flexible flat plate-shaped dielectric layer (flexible substrate).

First, referring to FIG. 12A, the ground electrodes GND1 and GND2 are laminated on the front surface and the rear surface of a portion other than an end portion 136 of a flat plate-shaped dielectric layer 130E, respectively. Thereafter, as illustrated in FIG. 12B, the end portion 136 is bent to form the space 132 between the ground electrode GND1 and the end portion 136, so that the first portion 151 illustrated in FIG. 4 is formed. Then, the antenna element 121 is disposed on the portion having been formed as described above. Note that the antenna element 121 may be laminated on the rear surface of the end portion 136 in the process in which the ground electrodes GND1 and GND2 are laminated.

Furthermore, the third dielectric layer 130A is laminated on the ground electrode GND1 and the antenna element 121A is further laminated thereon, whereby the third portion 153 is formed. Then, the RFIC 110 is disposed on the ground electrode GND2 (FIG. 12C).

Note that, in the above description, the third portion is formed by the laminated structure, but may be formed by bending the other end portion of the dielectric layer, similarly to the first portion. At this time, in a case where a space such as the first portion is unnecessary, the bent dielectric layer and the ground electrode GND1 are brought into close contact with each other.

As described above, in FIGS. 12A, 12B and 12C, an end portion of the dielectric layer is bent to face the ground electrode in a state in which a space is maintained between the end portion and the ground electrode GND1, whereby a portion corresponding to the first dielectric layer is formed.

(Example of Attachment to Communication Device)

FIG. 13 is a diagram for explaining an arrangement example of the antenna module 100A in the communication device 10 equipped with the antenna module 100A illustrated in FIG. 4.

Referring to FIG. 13, the RFIC 110 of the antenna module 100A is connected to a mounting substrate 50 via solder bumps (not illustrated) or the like at a surface on the opposite side to the second dielectric layer 135. The mounting substrate 50 not only functions as a substrate for fixing the antenna module 100A, but also functions as a heat sink for releasing the heat generated in the RFIC 110.

The antenna elements 121 and 121A of the antenna module 100A radiate radio waves to the outside of the communication device 10, and are each disposed in a position close to a housing 20 of the communication device 10 in order to receive radio waves from the outside.

Since a metal material may generally function as a shield against radio waves, when the housing 20 is formed of a metal material, resin portions 30 made of resin capable of passing radio waves therethrough are partially formed, and the antenna elements 121 and 121A are disposed so as to face the resin portions 30 respectively. As a result, it is possible to appropriately transmit and receive the radio waves while being unlikely to be affected by the metal housing. Note that there may be a gap between each of the antenna elements 121, 121A and 121B, and each of the resin portion 30.

In a case where the whole housing 20 is formed of resin, the antenna elements 121 and 121A may be disposed in any positions.

Second Embodiment

In the antenna module of the first embodiment, described is the configuration in which the dielectric layer on which the antenna element is disposed has a substantially rectangular shape when seen in a plan view, and the two antenna elements in FIG. 4, for example, are linearly arranged.

The antenna module may be used in a small and thin communication device such as a smart phone, and may be required to be disposed in a limited space in the device. In this case, depending on an attachment location of the antenna module, it may be necessary to dispose two antenna elements by offsetting the antenna elements. By doing so, in the linear antenna arrangement, there is a possibility that mechanical stress is applied to the dielectric layer and a crack or the like is generated in the dielectric layer.

Then, in the second embodiment, a configuration is described in which a dielectric layer of an antenna module is formed in a crank shape and two antenna elements are offset and disposed.

Each of FIGS. 14A and 14B is a diagram for explaining an antenna module 100B according to the second embodiment. A cross-sectional view thereof is illustrated in FIG. 14A, and a plan view thereof is illustrated in FIG. 14B. In FIGS. 14A and 14B, when compared with the antenna module 100A described in FIG. 4, the antenna module 100B is different therefrom only in a point that the second dielectric layer 135 is replaced with a second dielectric layer 135B and in a point that the RFIC 110 is disposed in the third portion 153, and the other constituent elements are the same as those in FIG. 4. Therefore, in FIGS. 14A and 14B, the description of the constituent elements overlapping with those in FIG. 4 will not be repeated.

Referring to FIGS. 14A and 14B, the second dielectric layer 135B is bent in a direction orthogonal to an extending direction from the first portion 151 toward the second portion 152 when seen in a plan view (FIG. 14B). In other words, the second dielectric layer 135B bends in an approximately S shape from the first portion 151 toward the third portion 153. Accordingly, the antenna element 121 and the antenna element 121A may be arranged in a state of being offset from each other. Note that the offset amount is designed in accordance with a device in which the antenna module 100B is mounted.

Here, a bend start point SP on the first portion 151 side is set in the space 132 in the first portion 151. By doing so, the curvature of the bent portion of the second dielectric layer 135B may be made to be gentler than that in a case where a boundary between the first portion 151 and the second portion 152 is set as the start point. As a result, mechanical stress applied to the second dielectric layer 135B may be reduced when the antenna module 100B is attached or the like.

Note that, in the above-described embodiments, the configuration in which the radiating element is disposed on the front surface of the dielectric layer is cited as an example and described. However, the radiating element may be configured to be disposed inside the dielectric layer. That is, the radiating element may not be exposed from the dielectric layer, and may be covered with a resist or a coverlay, which is a thin-film dielectric layer. Likewise, a ground electrode may also be configured to be formed inside the dielectric layer.

In the above-described embodiments, an example is described in which a portion of each of the dielectric layers 130E, 135, and 135B through which the feeding line from the RFIC 110 passes forms a strip line, where the ground electrodes are disposed on both surfaces of the dielectric layer. However, these dielectric layers may be formed as a microstrip line, where the ground electrode is disposed on only one side of the dielectric layer, or as a coplanar line, where the ground electrode and the feeding line are disposed in the same layer in the dielectric layer.

It is to be noted that the embodiments disclosed herein are illustrative in all respects and are not restrictive. The scope of the present disclosure is indicated by the claims rather than the description of the above-described embodiments, and it is intended to include all meanings equivalent to the claims and all modifications within the claims.

10 COMMUNICATION DEVICE
20 HOUSING
30 RESIN PORTION
50 MOUNTING SUBSTRATE
100, 100A, 100B, 100# ANTENNA MODULE
110, 110A, 110B RFIC
111A-111D, 113A-113D, 117 SWITCH
112AR-112DR LOW-NOISE AMPLIFIER
112AT-112DT POWER AMPLIFIER
114A-114D ATTENUATOR
115A-115D PHASE SHIFTER
116 SIGNAL SYNTHESIZER/DEMULTIPLEXER
118 MIXER
119 AMPLIFICATION CIRCUIT
120 ANTENNA ARRAY
121, 121A ANTENNA ELEMENT
130, 130_1, 130_2, 130A, 130B, 130D, 130#, 130E, 135, 135B DIELECTRIC LAYER
131, 131A, 131B SUPPORT PORTION
132, 132B, 132C, 132D, 155 SPACE
133, 133A MAIN BODY PORTION
136 END PORTION
140, 140A FEEDING LINE
150 MEMBER
151 FIRST PORTION
152 SECOND PORTION
153 THIRD PORTION
GND1, GND2 GROUND ELECTRODE
SP BEND START POINT

The invention claimed is:

1. An antenna module comprising:
at least one radiating element;
a ground electrode; and
a dielectric layer provided between the at least one radiating element and the ground electrode, wherein the at least one radiating element is mounted on the dielectric layer,
wherein a space is provided between the dielectric layer and the ground electrode in a region where the at least one radiating element and the ground electrode overlap each other when the dielectric layer is seen in a plan view, and
wherein the dielectric layer has a first portion and a second portion, the at least one radiating element is disposed in the first portion, the at least one radiating element is not disposed in the second portion, and the second portion of the dielectric layer provides access to the space.

2. The antenna module according to claim 1, wherein a thickness of the dielectric layer in a normal line direction in the second portion is thinner than a thickness of the dielectric layer in the normal line direction in the first portion.

3. The antenna module according to claim 2, further comprising:
at least one feeding circuit mounted in or on the dielectric layer and configured to supply radio frequency power to the at least one radiating element,
wherein the dielectric layer further has a third portion, a thickness of the dielectric layer in the normal line direction in the third portion is thicker than the thickness of the dielectric layer in the normal line direction in the second portion, and the third portion is different from the first portion, and
the at least one feeding circuit is disposed in the third portion.

4. The antenna module according to claim 3, further comprising:
another radiating element disposed in the third portion,
wherein the at least one feeding circuit is disposed on a surface on an opposite side to a surface on which the other radiating element is disposed in the third portion.

5. A communication device equipped with the antenna module according to claim 3, the device comprising:
a housing at least partially comprised of resin,
wherein the at least one radiating element of the antenna module is disposed so as to face the resin portion in the housing.

6. The antenna module according to claim 2,
wherein the dielectric layer bends in a direction orthogonal to an extending direction of the dielectric layer from the first portion to the second portion when seen in a plan view from the normal line direction of the dielectric layer, and the bend is started in the space in the first portion.

7. The antenna module according to claim 2, further comprising:
at least one feeding circuit mounted in or on the dielectric layer and configured to supply radio frequency power to the at least one radiating element; and
a feeding line provided in the dielectric layer and configured to transmit radio frequency power from the at least one feeding circuit to the at least one radiating element.

8. A communication device equipped with the antenna module according to claim 2, the device comprising:
a housing at least partially comprised of resin,
wherein the at least one radiating element of the antenna module is disposed so as to face the resin portion in the housing.

9. The antenna module according to claim 1, further comprising:
at least one feeding circuit mounted in or on the dielectric layer and configured to supply radio frequency power to the at least one radiating element; and
a feeding line provided in the dielectric layer and configured to transmit radio frequency power from the at least one feeding circuit to the at least one radiating element.

10. The antenna module according to claim 9,
wherein the at least one radiating element is more than one in number, and the plurality of radiating elements is disposed separate from one another in a planar direction of the dielectric layer, and the feeding circuit is provided correspondingly to each of the radiating elements.

11. The antenna module according to claim 10, wherein the ground electrode is provided under a lower boundary of the space.

12. A communication device equipped with the antenna module according to claim 9, the device comprising:

a housing at least partially comprised of resin, wherein the at least one radiating element of the antenna module is disposed so as to face the resin portion in the housing.

13. The antenna module according to claim 1, further comprising:

at least one feeding circuit mounted in or on the dielectric layer and configured to supply radio frequency power to the at least one radiating element, wherein the at least one feeding circuit is disposed in the first portion of the dielectric layer.

14. A communication device equipped with the antenna module according to claim 13, the device comprising:

a housing at least partially comprised of resin, wherein the at least one radiating element of the antenna module is disposed so as to face the resin portion in the housing.

15. The antenna module according to claim 1, further comprising:

at least one feeding circuit mounted in or on the dielectric layer and configured to supply radio frequency power to the at least one radiating element, wherein the at least one feeding circuit is disposed in the second portion of the dielectric layer.

16. A communication device equipped with the antenna module according to claim 15, the device comprising:

a housing at least partially comprised of resin, wherein the at least one radiating element of the antenna module is disposed so as to face the resin portion in the housing.

17. The antenna module according to claim 1, wherein an upper surface of the second portion is continuously connected with a lower boundary of the space provided in the dielectric layer.

18. The antenna module according to claim 1, wherein, when the dielectric layer is seen in a plan view, an entirety of the at least one radiating element overlaps the space.

19. The antenna module according to claim 1, wherein one end portion of the dielectric layer in the first portion is bent to face the ground electrode, and another end portion of the dielectric layer in the second portion does not face the ground electrode, and a thickness of the dielectric layer in a normal line direction in the second portion is thinner than a thickness of the dielectric layer in the normal line direction in the first portion.

20. A communication device equipped with the antenna module according to claim 1, the device comprising:

a housing at least partially comprised of resin, wherein the at least one radiating element of the antenna module is disposed so as to face the resin portion in the housing.

* * * * *